US005575007A

United States Patent [19]

Gaffney

[11] Patent Number: 5,575,007

[45] Date of Patent: Nov. 19, 1996

[54] REVERSIBLE NECKTIE AND METHOD FOR MAKING SAME

[75] Inventor: James Gaffney, Dorchester, Mass.

[73] Assignee: Esquire Neckwear, Inc., Quincy, Mass.

[21] Appl. No.: 232,485

[22] Filed: Apr. 25, 1994

[51] Int. Cl.[6] ..... A41D 25/00; A41D 25/16; A41D 27/00

[52] U.S. Cl. ..... 2/144; 2/146; 2/243.1

[58] Field of Search ..... 2/144, 145, 147, 2/148, 149, 150, 151, 152, 153, 154, 155, 156, 157, 243.1, DIG. 2, 146

[56] References Cited

U.S. PATENT DOCUMENTS

| | | | |
|---|---|---|---|
| 1,698,520 | 1/1929 | Wollman | 2/146 |
| 1,906,120 | 4/1933 | Waltz | 2/146 |
| 2,024,151 | 12/1935 | Dombrowsky et al. | 2/146 |
| 2,668,294 | 2/1954 | Gilpin | 2/114 |
| 2,890,460 | 6/1959 | Levi | 2/144 |
| 3,264,654 | 8/1966 | Woronowicz et al. | 2/146 |
| 3,744,057 | 7/1973 | Luceri | 2/146 |
| 3,953,894 | 5/1976 | Aron | 2/146 |

FOREIGN PATENT DOCUMENTS

| | | | |
|---|---|---|---|
| 498934 | 11/1954 | Italy | 2/146 |
| 193904 | 11/1937 | Switzerland | 2/146 |

*Primary Examiner*—Jeanette E. Chapman
*Attorney, Agent, or Firm*—Herbert L. Bello

[57] ABSTRACT

A reversible necktie having two different sides, the necktie being worn with either side facing outward from the wearer, including a pair of fabrics cut into matching necktie shapes, sewn together along their longitudinal side edges, and a liner sewn to the stitched fabric pieces at the wide end of the necktie, the sewing forming a continuous internal seam. The small ends of the fabric pieces are folded and sewn. No external stitching is visible on the completed necktie.

12 Claims, 4 Drawing Sheets

REVERSIBLE NECKTIE AND METHOD FOR MAKING SAME

BACKGROUND OF THE INVENTION

1. Field of the Invention

The present invention relates to neckties, and, more particularly, is directed towards reversible neckties which can be worn with either of two sides facing outward from the wearer.

2. Description of the Prior Art

Reversible neckties having two sides or faces, each face being suitable for facing outward from the wearer, are well known in the industry. The materials used in the two sides of the necktie may be of different colors or different types of fabric, or may have different imprinted patterns. Both sides are most commonly joined together by stitching operations when the necktie is turned inside out. The necktie is stitched with a discontinuous peripheral seam to leave an open area for everting the necktie. After the necktie is everted, the open area is stitched closed. Therefore, some stitching remains visible in the completed necktie.

U.S. Pat. No. 3,744,057 to Luceri discloses two methods of fabricating a reversible necktie. In both methods, the peripheral seam is completed by a stitching operation performed after the necktie assembly is turned "right side out" or everted. This method suffers from the disadvantage that stitching is visible in the neck band region of the necktie.

U.S. Pat. No. 3,959,825 to Hughes discloses a reversible necktie in which the peripheral seam is completed by means of an outside lock stitch placed in the neck band region after eversion of the necktie. This method also suffers from the disadvantage that the stitching is visible in the neck band region of the necktie.

The present state of the art indicates a need for a method of fabricating a reversible necktie in which no visible line of stitching is present in the peripheral seam of the completed necktie.

SUMMARY OF THE INVENTION

It is a object of the present invention to provide a reversible necktie which does not suffer from the heretofore mentioned disadvantages and limitations.

It is a further object of the present invention to provide a reversible necktie in which no external stitching is visible on the completed necktie.

It is a further object of the invention to provide a method for making a reversible necktie in which the required stitching or joining operations are completed prior to the eversion of the necktie.

The present invention is characterized by a reversible necktie having two different sides, the necktie being worn with either side facing outward from the wearer. The necktie includes a pair of fabrics that are cut into matching necktie shapes, each cut fabric having a wide end and a narrow end. The cut fabric pieces are superposed with the finished side of the fabrics in face-to-face relationship. The fabric pieces are sewn together along their longitudinal side edges. A liner is superposed on one face of one of the sewn fabrics and stitched to the sewn fabric pieces at the wide end thereof. The narrow end of each necktie shaped fabric piece is folded and sewn. The necktie is everted so that the finished face of each fabric piece is on the outside of the necktie. Since all sewing is done prior to eversion, no stitching is visible in the everted necktie.

Other objects of the present invention will in part be obvious and will in part appear hereinafter.

The invention accordingly comprises the apparatuses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
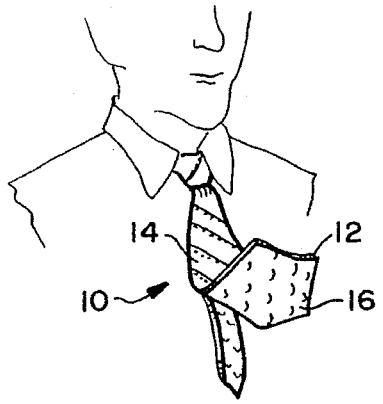
FIG. 1 is a perspective view of a reversible necktie embodying the present invention, as it is worn, with the wide end turned to show the other side.

Referring now to the drawings, particularly FIG. 1, there is shown a reversible necktie 10 embodying the invention. In the illustrated embodiment necktie 10 is of the configuration generally referred to in the industry as a "four-in-hand" necktie, that is, a necktie tied in a slipknot with the ends left hanging when being worn. A wide end 12 of necktie 10 is lifted to show that necktie 10 is reversible and includes a striped side 14 and a patterned side 16. Although striped side 14 is being worn facing outward, it is to be understood that necktie 10 can be removed and retied so that patterned side 16 is worn facing outward.

Figure 3:
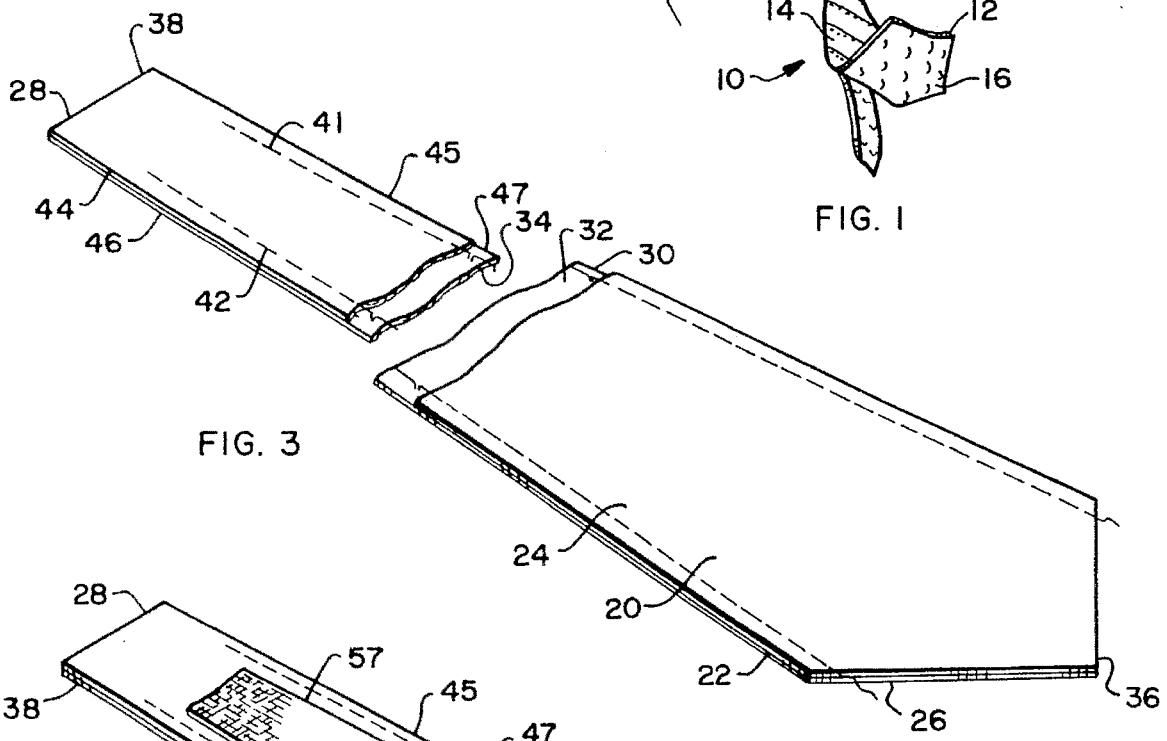
FIG. 3 is a perspective view showing the pair of necktie-shaped fabric pieces of FIG. 2 sewn together.
Figure 2:
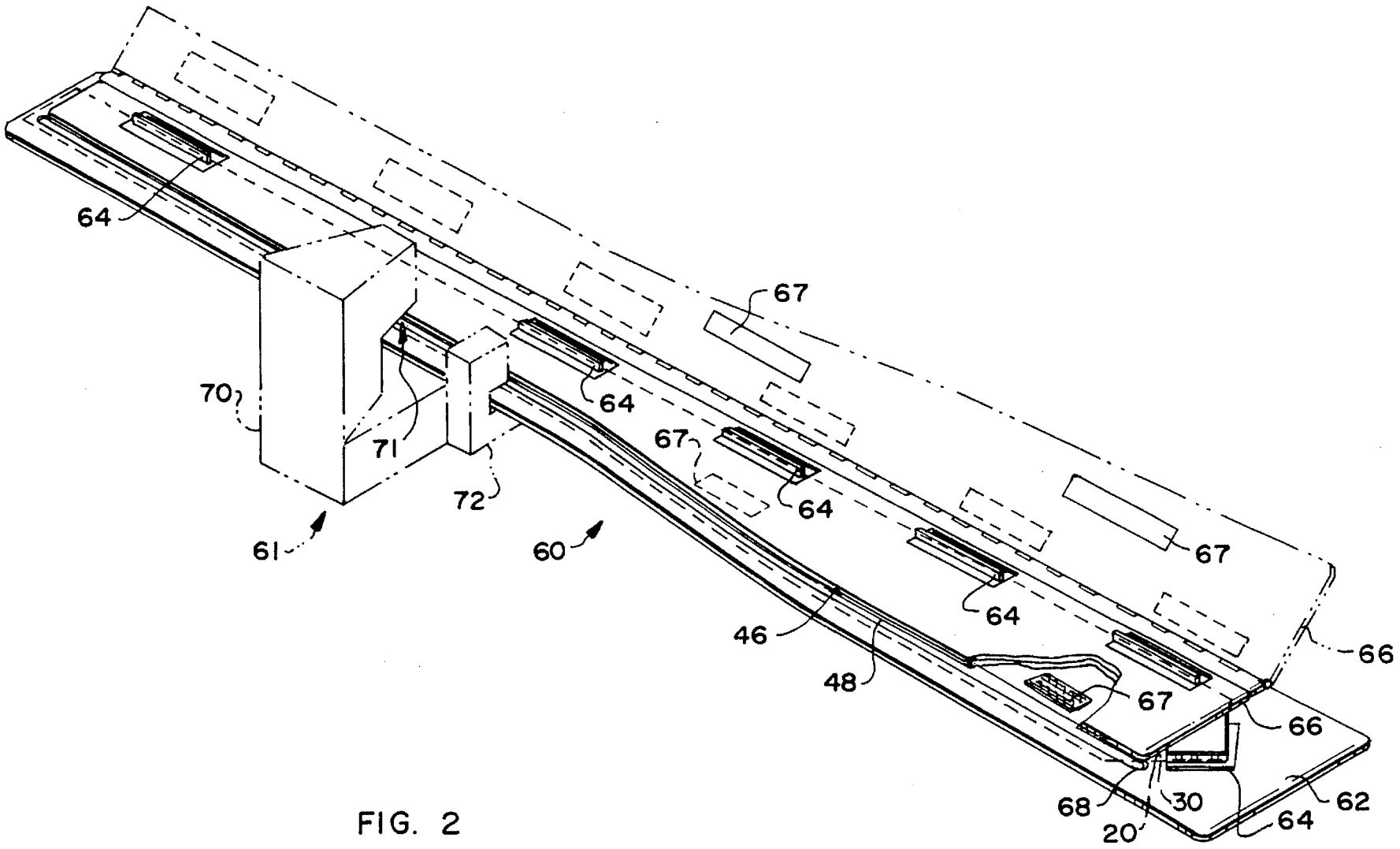
FIG. 2 is a perspective view of a pair of necktie-shaped fabric pieces placed within a template in preparation for a stitching operation.

The initial steps of fabricating reversible necktie 10, according to the present invention, are shown in FIGS. 2 and 3. FIG. 2 shows a template 60 that is used in an initial sewing operation and FIG. 3 shows an intermediate step in the fabrication process in which the initial sewing operation has been completed.

As best shown in FIG. 3, a first necktie-shaped fabric piece 20 having a face side 22, an underside 24, a wide end 26, and a narrow end 28 is superposed on a second fabric piece 30 having a finished face side 32, an underside 34, a wide end 36, and a narrow end 38. In the preferred embodiment, first and second fabrics are stacked with the finished faces 22, 32 in face-to-face relationship and cut so that fabric piece 20 and fabric piece 30 are matched pieces. That is, fabric pieces 20 and 30 have substantially the same shape, length, and width. It is to be understood that fabric pieces 20 and 30 have different designs or patterns on finished faces 22 and 32. However, fabric pieces 20 and 30 can be of the same or of different materials or imprinted patterns. Fabric piece 20 is secured to fabric piece 30 by lines of stitching 41 and 42. Seam allowances are made sufficiently large to preclude the unraveling of fabric at longitudinal edges 44, 45, 46, and 47.

As best shown in FIG. 2, fabric pieces 20 and 30 are aligned and attached using a template 60 and an attaching and conveying assembly 61 which includes an attaching device 70 and a conveying device 72. Fabric pieces 20 and 30 are positioned upon a template base 62, resting against a plurality of template stops 64, and held against template base 62 by means of a cover 66. Cover 66 is also shown, in phantom, in an open position. Template 60 includes a plurality of grips 67 to prevent the movement of fabric pieces 20 and 30 along the surface of template base 62 during the sewing operation. The grips 67 may be small segments of material having a high coefficient of friction, such as foam rubber or cork sheet, attached to the lower surface of cover 66 and/or to the upper surface of template base 62.

When fabric pieces 20 and 30 are secured in template 60, longitudinal edges 46 and 48 remain accessible to attaching device 70, for example a sewing machine 70. In this case, template 60 is provided with a slot 68 running lengthwise in template base 62 proximate the longitudinal edges 46 and 48 of the properly-positioned fabric pieces 20 and 30, the needle of the sewing machine 70 reciprocating in the slot. To facilitate fabrication, conveying device 72 is employed to move template 60 with respect to sewing machine 70 as fabric piece 20 is being attached to fabric piece 30. Upon completion of the stitching of the longitudinal edges of fabric pieces 20 and 30, a fabric liner 50 is attached to the fabric piece as shown in FIG. 4.

Figure 4:
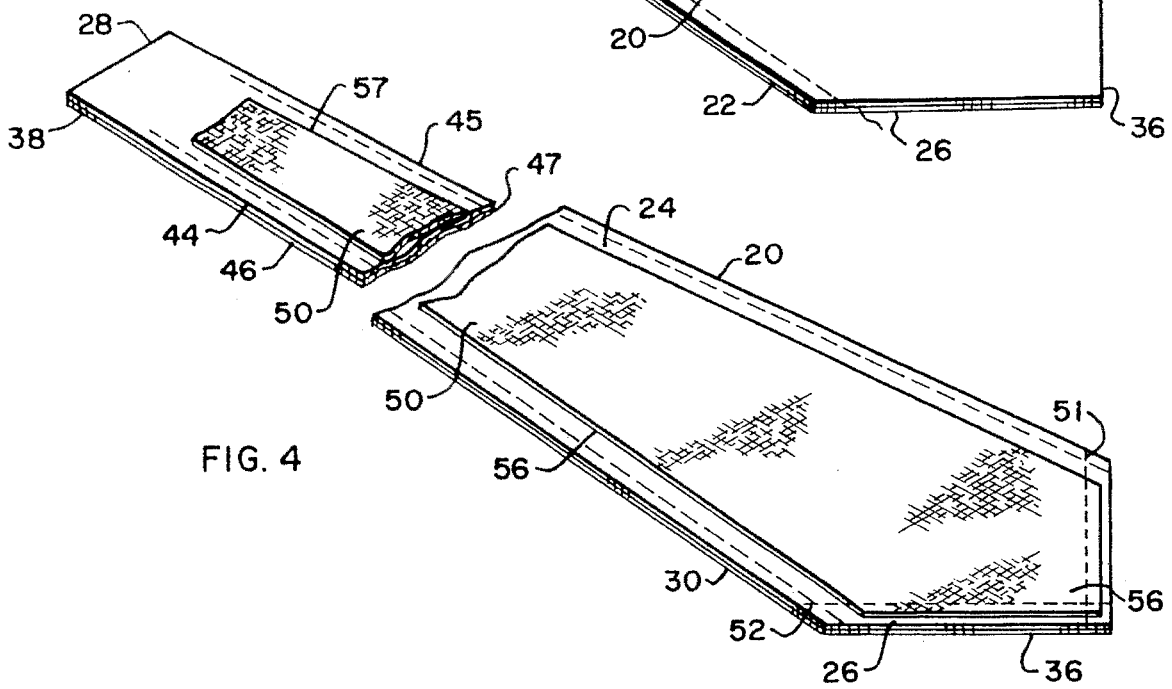
FIG. 4 is a perspective view showing attachment of a fabric liner to the pair of necktie-shaped fabric pieces of FIG. 2.

Referring now to FIG. 4, it will be seen that fabric liner 50 is secured to underside 24 of fabric piece 20 by lines of stitching 51 and 52 which pass through wide end 26 of fabric piece 20, wide end 56 of fabric liner 50 and through wide end 36 of fabric piece 30. Wide end 26 of fabric piece 20 is secured to wide end 36 of fabric piece 30 by attaching means, for example lines of stitching 51 and 52. In an alternate embodiment, wide ends 26 and 36 are sewn together in one operation and liner 50 is sewn to fabric pieces 20 and 30 in a separate operation. Fabric liner 50 serves to provide body to necktie 10 so as to maintain a generally uniform planar thickness across the face of the completed necktie. This uniformity is best accomplished by cutting fabric liner 50 so that the longitudinal edge 56 of fabric liner 50 abuts longitudinal edges 44 and 46 of fabric pieces 20 and 30 respectively, and longitudinal edge 57 of fabric liner 50 abuts longitudinal edges 45 and 47 of fabric pieces 20 and 30 respectively, when the necktie is everted as shown in FIG. 6. Upon completion of the step of attaching liner 50, narrow ends 28 and 38 are finished as shown in FIGS. 5*a* through 5*d*.

Figure 5A:
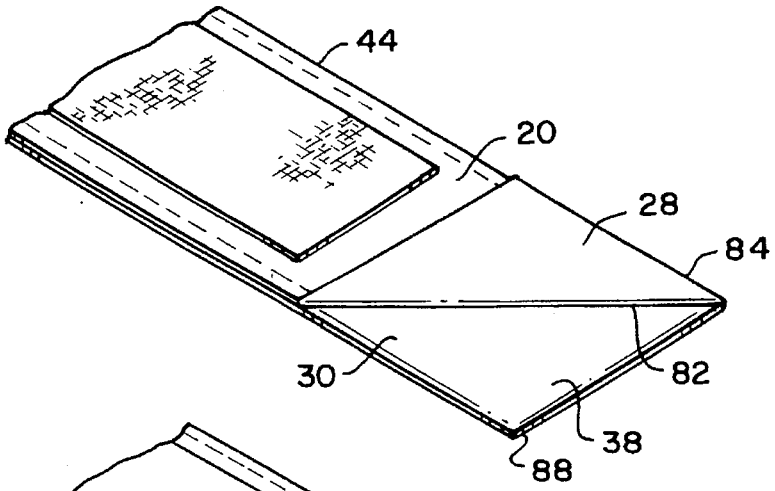
FIGS. 5(*a*) to 5(*d*) are perspective views showing the sequence of operations in stitching the narrow ends of the fabric pieces.
Figure 5B:
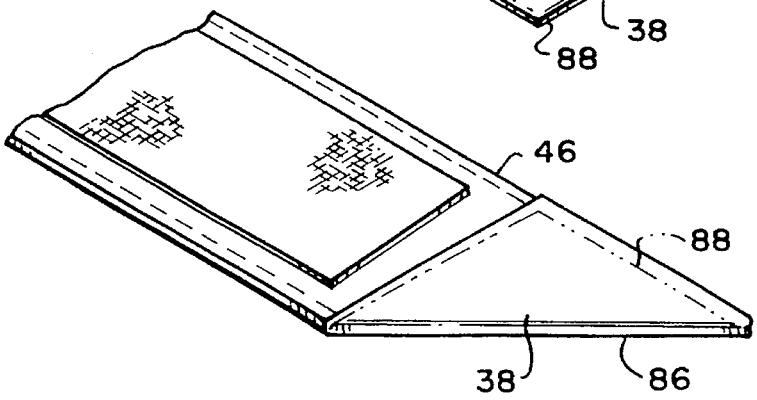
Figure 5C:
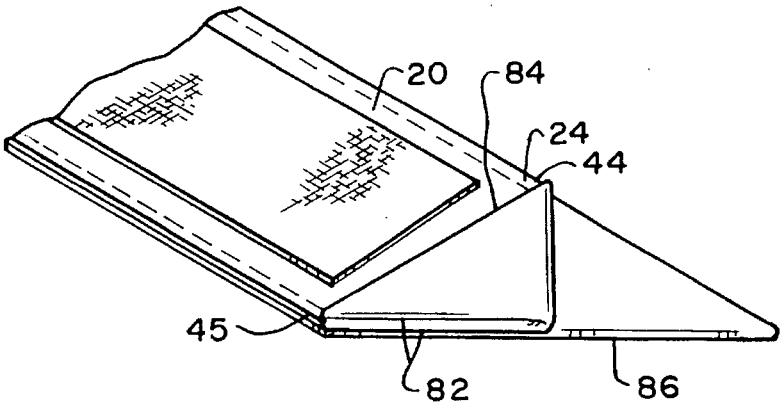
Figure 5D:
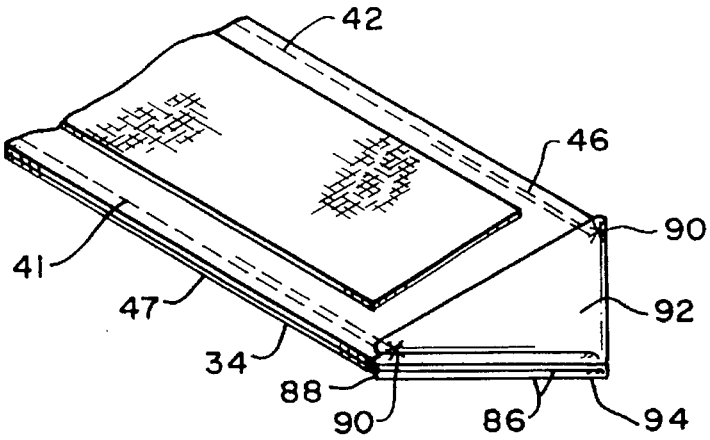
Figure 6:
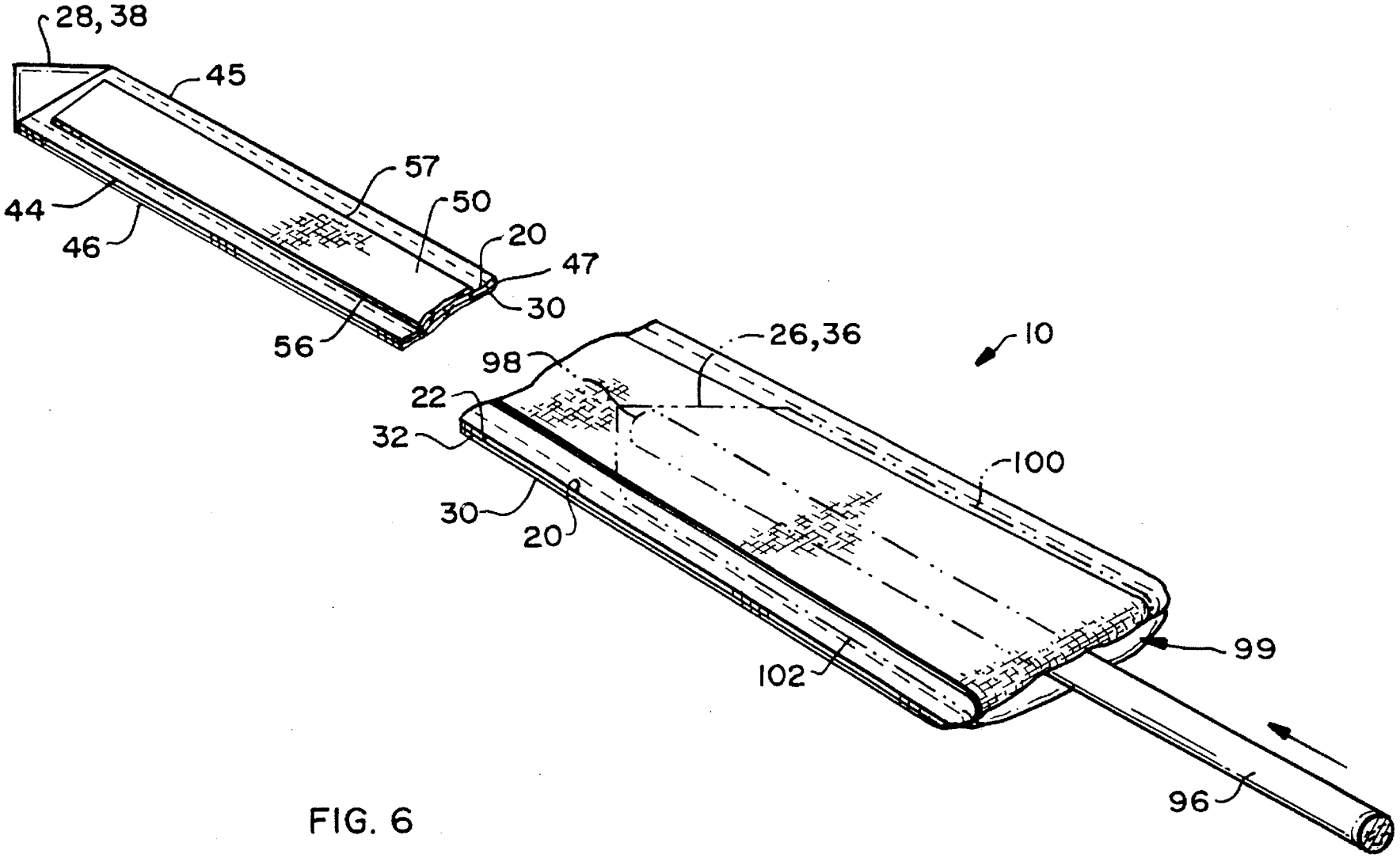
FIG. 6 is a perspective view showing the operation of everting the necktie assembly to complete the fabrication process.

Referring now to FIGS. 5*a* through 5*d*, there are shown the steps of finishing narrow end 28 of fabric piece 20 and narrow end 38 of fabric piece 30. The material proximate narrow end 28 is folded onto itself, underside-to-underside, by means of diagonal fold-line 82 to bring narrow edge 84 adjacent to longitudinal edge 44 (FIG. 5*a*). Similarly, the material proximate narrow end 38 is folded onto itself, underside-to-underside, by means of diagonal fold-line 86 to bring narrow edge 88 adjacent to longitudinal edge 46 (FIG. 5*b*). Diagonal fold-line 82 is folded upon itself to position narrow edge 84 proximate underside 24 of fabric piece 20, with the result that narrow edge 84 extends from longitudinal edge 44 to longitudinal edge 45 (FIG. 5*c*). Similarly, diagonal fold-line 86 is folded upon itself to position narrow edge 88 proximate underside 34 of fabric piece 30, with the result that narrow edge 88 extends from longitudinal edge 46 to longitudinal edge 47 (FIG. 5*d*). It can be appreciated by one skilled in the art that the foregoing operational steps can be performed in a different sequence while achieving the same configuration as illustrated in FIG. 5*d*. The resulting hems 92 and 94 are secured by attaching means, for example stitching lines 90 which are positioned to lie outward of stitching lines 41 and 42, thus insuring that no stitching remains visible in completed necktie 10. In an alternative embodiment, the hems comprise a turned-up narrow edge, realized with a single fold line intersecting the longitudinal edges of the associated fabric pieces, the hems being secured by a means similar to the means described in the preferred embodiment. Once narrow ends 28 and 38 have been finished, necktie 10 is everted as shown in FIG. 6 to complete the fabrication process.

Referring now to FIG. 6, there is illustrated the step of everting necktie 10 to complete the fabrication process. Wide ends 26 and 36 are urged into an internal chamber 99 formed between fabric pieces 20 and 30 by means of everting tool 96, for example a rod, having a blunt end 98. The everting process continues and wide ends 26 and 36 emerge at the opening defined by narrow ends 28 and 38. The everting process is completed when necktie 10 has been fully everted and the face sides 22 and 32 are fully exposed and the entire continuous seam lies disposed within the internal chamber 99. This eversion process positions fabric liner 50 within necktie 10 such that fabric liner edges 56 and 57 abut fabric piece edges 45, 47, 46 and 48 at lineal interfaces 100 and 102 respectively. Fabric liner 50 thus provides body and shape to reversible necktie 10, which is then pressed and worn as shown in FIG. 1.

In an alternative embodiment, thermal or chemical bonding can be employed to attach fabric pieces 20 and 30 to one another. The securing of liner fabric 50 to underside 24 can be accomplished either by means of such bonding, or by a separate stitching operation in which lines of stitching 53 and 54 pass through fabric liner 50 and fabric piece 20 only.

It should be understood that changes may be made in the above construction and in the foregoing sequences of operation without departing from the scope of the invention. It is accordingly intended that all matter contained within the above description or shown in the accompanying drawings be interpreted in an illustrative, rather than in a limiting, sense.

It should also be understood that the following claims are intended to cover all of the generic and specific features of the invention as described herein, and all statements of the scope of the invention which, as a matter of language, might be said to fall therebetween.

What is claimed is:

1. A reversible necktie comprising:

(a) first and second fabric pieces, said fabric pieces cut into matching necktie shapes, each said fabric piece having a finished face side, a wide end, longitudinal edges, and a narrow end, said fabric pieces superimposed in mating relationship with said finished sides facing outward; and (b) attaching means for securing said longitudinal edges of said first and second fabric pieces to one another, said attaching means being a continuous internal seam that is spaced adjacent to and running substantially parallel to said superimposed longitudinal edges on each side of said fabric pieces, said continuous seam running from an innermost point of said wide end to an innermost point of said narrow end, said wide end being closed and said narrow end being open, said wide end closed by said continuous seam, said narrow end having a hem, said hem being defined by at least a first diagonal fold and a second diagonal fold in said first and second fabric pieces, said first and second diagonal folds overlying each other, said first and second diagonal folds in said fabric pieces being secured in position with a pair of internal stitch lines disposed outside of said attaching means securing said longitudinal edges of said fabric pieces to one another, said open narrow end being positioned between said longitudinal edges.

2. The reversible necktie of claim 1 including a fabric liner that is sized to lie within said continuous internal seam, said liner having a wide end secured to said fabric piece wide ends by said attaching means, an internal chamber formed between said fabric pieces, said liner lying within said internal chamber, said continuous seam being disposed entirely within said internal chamber.

3. The reversible necktie of claim 2 a hem formed at said narrow end of each said fabric piece, said hems being secured by said attaching means.

4. The reversible necktie of claim 3 wherein said means for attaching is a continuous line of stitching.

5. The reversible necktie of claim 3 in which said means for attaching is thermal bonding.

6. The reversible necktie of claim 3 in which said means for attaching is chemical bonding.

7. The reversible necktie of claim 3 wherein the edges of said fabric liner abut said longitudinal edges of said fabric pieces, the planar thickness of said reversible tie is generally uniformly maintained by said fabric liner.

8. The reversible necktie of claim 3 wherein each said hem includes a turned-up narrow edge in which said fabric pieces are folded with a fold line intersecting both longitudinal edges of said fabric pieces.

9. A reversible necktie comprising:

(a) first and second fabric pieces said fabric pieces cut into matching necktie shapes having a finished face side, a wide end, longitudinal edges, and a narrow end;

(b) a line of stitching secured said longitudinal edges and wide ends of said first and second fabric pieces superimposed on one another, said line of stitching being a continuous internal seam that is adjacent to and running substantially parallel to said longitudinal edges on each side of said fabric pieces, said continuous seam running from an innermost point of said wide end to an innermost point of said narrow end, an internal chamber formed between said secured fabric pieces, said wide end being closed and said narrow end being open, said wide end closed by said continuous seam, said open narrow end having a pair of hemmed edges, said hemmed edges being defined by at least a first diagonal fold and a second diagonal fold in said first and second fabric pieces, said first and second diagonal folds overlying each other, said fabric pieces being secured in position with a pair of internal stitch lines disposed outside of said line of stitching securing said fabric pieces to one another such that both of said hemmed edges are positioned between said longitudinal edges; and (c) a fabric liner sized and shaped to lie within said continuous internal seam, said liner lying within said internal chamber formed between both said fabric pieces, said continuous seam being entirely disposed within said internal chamber.

10. The reversible necktie of claim 9 in which the edges of said fabric liner abut the longitudinal edges of said first and second fabric pieces, whereby the planar thickness of said reversible tie is generally uniformly maintained.

11. A reversible necktie comprising:

(a) first and second fabric pieces, said pieces cut into matching necktie shapes, each said fabric piece having a finished face side, a wide end, longitudinal edges, and a narrow end, said fabric pieces superimposed in mating relationship with said finished sides facing outward;

(b) first attaching means for securing said longitudinal edges of said first and second fabric pieces to one another, said first attaching means being a continuous internal seam that is spaced adjacent to and running substantially parallel to said superimposed longitudinal edges on each side of said fabric pieces, said continuous seam running from an innermost point of said wide end to an innermost point of said narrow end;

(c) a fabric liner that is sized and shaped to lie within said continuous internal seam, said liner having a side end secured to said fabric piece wide ends by said first attaching means, an internal chamber formed between said fabric pieces, said liner lying within said internal chamber, said continuous seam being disposed entirely within said internal chamber;

(d) second attaching means; and (e) a first hem and a second hem formed at said narrow end of each said fabric piece, each said hem being secured by said second attaching means, said first hem including a first hemmed narrow edge, said second hem including a second hemmed narrow edge, said first hemmed narrow edge and said second hemmed narrow edge extending between said longitudinal edges said fabric pieces being folded diagonally along a first line so as to form said first hemmed narrow edge, said fabric pieces being folded along a second diagonal line so as to form said second hemmed narrow edge.

12. A reversible necktie comprising:

(a) first and second fabric pieces, said pieces cut into matching necktie shapes having a finished face side, a wide end, longitudinal edges, and a narrow end;

(b) a first line of stitching securing said longitudinal edges and wide ends of said first and second fabric pieces superimposed on one another, said first line of stitching being a continuous internal seam that is adjacent to and running substantially parallel to said longitudinal edges on each side of said fabric pieces, said continuous seam running from an innermost point of said wide end to an innermost point of said narrow end, an internal chamber formed between said secured fabric pieces;

(c) a fabric liner sized and shaped to lie within said continuous internal seam, said liner lying within said internal chamber formed between both said fabric pieces, said continuous seam being entirely disposed within said internal chamber;

(d) a second line of stitching; and (e) a first hem and a second hem formed at the narrow end of each said fabric piece, each said fabric piece proximate said narrow end being folded onto itself, underside-to-underside, each said hem being secured by said second line of stitching, said first hem having a first hemmed narrow edge, said second hem including a second hemmed narrow edge, said first hemmed narrow edge and said second hemmed narrow edge extending between said longitudinal edges, said fabric pieces being folded diagonally along a first line so as to form said first hemmed narrow edge, said fabric pieces being folded diagonally along a second diagonal line so as to form said second hemmed narrow edge.

* * * * *